US011795742B2

(12) United States Patent
Lewis

(10) Patent No.: US 11,795,742 B2
(45) Date of Patent: Oct. 24, 2023

(54) CONTROLLED ACCESS DOOR BARRICADE SYSTEM

(71) Applicant: JENDYK MANUFACTURING, INC., Swainsboro, GA (US)

(72) Inventor: Bryant F. Lewis, Swainsboro, GA (US)

(73) Assignee: JENDYK MANUFACTURING, INC., Swainsboro, GA (US)

( * ) Notice: Subject to any disclaimer, the term of this patent is extended or adjusted under 35 U.S.C. 154(b) by 85 days.

(21) Appl. No.: 17/168,541

(22) Filed: Feb. 5, 2021

(65) Prior Publication Data

US 2021/0254375 A1 Aug. 19, 2021

Related U.S. Application Data

(60) Provisional application No. 62/976,396, filed on Feb. 14, 2020.

(51) Int. Cl.
*E05C 19/00* (2006.01)

(52) U.S. Cl.
CPC ..... *E05C 19/003* (2013.01)

(58) Field of Classification Search
CPC ..... E05C 19/003
See application file for complete search history.

(56) References Cited

U.S. PATENT DOCUMENTS 3,768,284 A * 10/1973 Kent ..... E05B 15/1614 70/448
4,214,783 A * 7/1980 Boegeman ..... E05C 1/04 292/DIG. 60
2014/0165368 A1* 6/2014 Cordova ..... H02G 3/121 411/102

* cited by examiner

*Primary Examiner* — David R Hare
*Assistant Examiner* — Thomas L Neubauer
(74) *Attorney, Agent, or Firm* — DORITY & MANNING, P.A.

(57) ABSTRACT

Disclosed are apparatus and corresponding and/or associated methodology for door barricade systems which may be activated from inside an enclosure (or room) while still maintaining controlled serviceability or access to the enclosure from outside of the enclosure. Per some embodiments, bolts passed through a doorframe as a retrofit feature may support an interior plate which has a channel or passage for receipt of a manually removable door block member. The bolts are secured by an exterior plate and custom nuts which have customized drive surfaces. Corresponding custom drive head features interface with the custom nuts for either installation or removal of the door barricade system, even if the door block member is in place. Corresponding hole features on the custom nuts match with custom drive head pin features to provide an effective keyed entrance, which is hardened against forced entry if a person outside the secured room does not have the appropriate custom drive head.

16 Claims, 12 Drawing Sheets

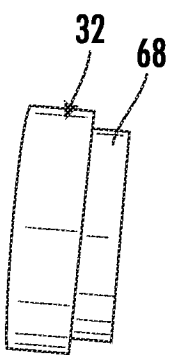
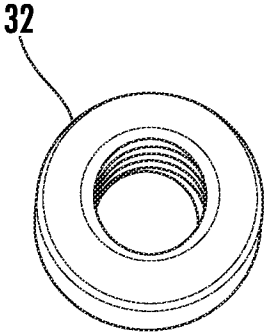
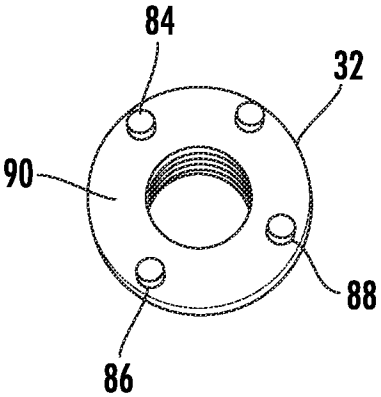
FIGURE 9C
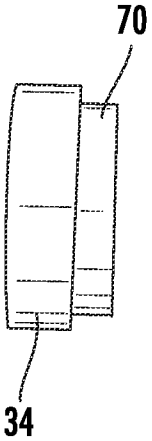
FIGURE 9B
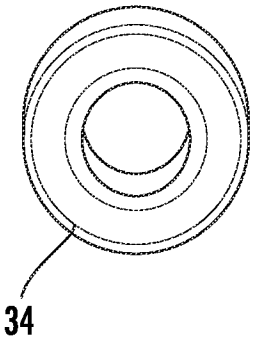
FIGURE 9A
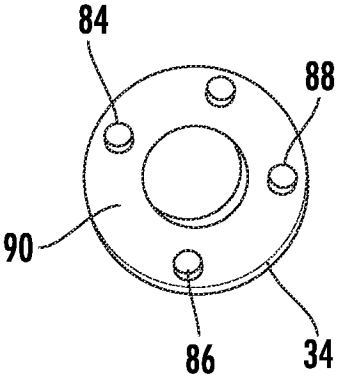

CONTROLLED ACCESS DOOR BARRICADE SYSTEM

PRIORITY CLAIM

This application claims the benefit of previously filed U.S. Provisional Patent Application entitled "CONTROLLED ACCESS DOOR SURFACE BOLT," assigned U.S. Ser. No. 62/976,396, filed Feb. 14, 2020, and which is incorporated herein by reference for all purposes.

FIELD OF THE SUBJECT MATTER

The presently disclosed subject matter generally relates to door surface bolt or barricade systems and more particularly to door surface bolt or barricade systems which may be activated from inside an enclosure (or room) while still maintaining controlled serviceability or access to the enclosure from outside of the enclosure.

BACKGROUND OF THE SUBJECT MATTER

Various types of door closure or locking systems have been devised for use in applications for securing doors. For example, relatively reinforced doors may have a handle or door knob with a built-in lock or locking mechanism, which when actuated, would ostensibly prevent someone from illicitly opening the door. For example, in the case of an unauthorized intruder, a school teacher might lock an existing door lock in an attempt to prevent entry into the room, or otherwise use some form of deadbolt to physically block the door. However, in the case of a door lock, it might be possible to physically overcome the lock quickly by application of sufficient turning force against the knob or by using a pry bar or by having an unauthorized copy of a lock key. Thus, the overall system fails to be an adequate deterrence to unauthorized entry into a room.

In the case of a deadbolt or other physical door blocking device, it might not be possible for an authorized person outside the door to actually make reliable entry into the closed enclosure or room when desired, until the physical block was removed by someone from inside the room.

While various implementations of door closure or locking systems have been developed, no design has emerged that generally encompasses all of the desired characteristics as hereafter presented in accordance with the presently disclosed technology.

SUMMARY OF THE SUBJECT MATTER

In view of the recognized features encountered in the prior art and addressed by the presently disclosed subject matter, improved apparatus and corresponding methodology therefor have been provided for improved door barricade or surface bolt systems. More particularly, the presently disclosed subject matter relates to the use of door barricade or surface bolt systems which may be activated from inside an enclosure (or room) while still maintaining controlled serviceability or access to the enclosure from outside of the enclosure. Note that the terms bolt, surface bolt, and barricade may be used interchangeably throughout the present disclosure, for reference to presently disclosed subject matter.

One presently disclosed exemplary embodiment relates to an improved door barricade system which has no springs or internal mechanisms that can potentially malfunction. More particularly, in some presently disclosed embodiments, a door may be locked from inside of an associated room without opening the door or checking the door handle. Per some presently disclosed exemplary embodiments, the subject devices may provide the user (for example, a teacher) with clear visual confirmation that the associated target door is properly and fully but temporarily bolted or barricaded from easy unauthorized entry.

Per other presently disclosed features, per some presently disclosed exemplary embodiments, the presently disclosed barricade system nonetheless can be removed from a position which is exterior of the associated door through use of controlled access devices.

Per yet other presently disclosed features, per some presently disclosed exemplary embodiments, the presently disclosed barricade system may be retrofit to existing doors.

One presently disclosed exemplary embodiment relates to a controlled access door barricade system for retrofit use with an existing doorframe and associated door for securing an associated room. Such system may preferably comprise a pair of respective bolts with respective threaded ends on one end thereof and bolt heads on respective opposite ends thereof, for mounting through one of an existing doorframe and its associated door; an interior plate received on a side of the associated door interior to the associated room, with such bolts passed therethrough with such bolt heads to the interior side of the associated door; an exterior plate received on a side of the associated door exterior to the associated room, with such bolts passed therethrough with such bolt threaded ends to the exterior side of the associated door; a pair of nuts receivable on such bolt threaded ends for securing such bolts and such interior and exterior plates relative to the doorframe and associated door whenever such nuts are tightened on such bolt threaded ends; a channel at least partially formed by such interior plate for receipt of a manually removable door block member; and a door block member removably receivable in such channel by a user situated on the interior side of the associated door; wherein such nuts include custom drive engagement features, for controlled access to the interior of the room through use of a corresponding custom drive head with such bolts even when such door block member is received in such channel, so that the associated room may be secured from inside the room while maintaining controlled access to the room from outside of the room.

Another presently disclosed exemplary embodiment may relate to a retrofit barricade system for an existing doorframe and associated door for securing an associated room. Such system may preferably comprise a pair of respective bolts with respective threaded ends on one end thereof and bolt heads on respective opposite ends thereof, for mounting through an existing doorframe; respective interior and exterior plates received on opposite sides of the doorframe, with such bolts passed therethrough with such bolt heads to the interior side of the associated room; a pair of nuts receivable on such bolt threaded ends for securing such bolts and such interior and exterior plates relative to the doorframe whenever such nuts are tightened on such bolt threaded ends; a channel at least partially formed by such interior plate for receipt of a manually removable door block member; and a door block member removably receivable in such channel by a user situated on the interior side of the associated door; wherein such nuts include custom drive engagement features, for controlled access to the interior of the room through use of a corresponding custom drive head with such bolts even when such door block member is received in such channel, so that the associated room may be secured from inside the room while maintaining controlled access to the room from outside of the room; such bolts, such plates, and such nuts comprise heavy-duty components; and such door block member is sized to extend at least partially across both the existing doorframe and its associated door whenever received in such channel, for creating an interference block to opening of the associated door.

Those or ordinary skill will appreciate and understand from the complete disclosure herewith that the present disclosure equally relates to both apparatus and to corresponding and/or related methodologies. One presently disclosed exemplary embodiment relates to methodology for retrofit use of a controlled access door barricade system with an existing doorframe and associated door for securing an associated room. Such methodology preferably may comprise providing a pair of respective bolts with respective threaded ends on one end thereof and bolt heads on respective opposite ends thereof; mounting the pair of respective bolts through one of an existing doorframe and its associated door; providing an interior plate received on a side of the associated door interior to the associated room, with such bolts passed therethrough with such bolt heads to the interior side of the associated door, with such a channel at least partially formed by such interior plate for receipt of a manually removable door block member; providing an exterior plate received on a side of the associated door exterior to the associated room, with such bolts passed therethrough with such bolt threaded ends to the exterior side of the associated door; threading a pair of nuts on such bolt threaded ends for securing such bolts and such interior and exterior plates relative to the doorframe and associated door by tightening such nuts on such bolt threaded ends, wherein such nuts include custom drive engagement features, for controlled access to the interior of the room through use of a corresponding custom drive head with such bolts even when such door block member is received in such channel; and selectively removably receiving a door block member in such channel by a user situated on the interior side of the associated door, so that the associated room may be selectively secured from inside the room while maintaining controlled access to the room from outside of the room.

Additional objects and advantages of the presently disclosed subject matter are set forth in, or will be apparent to those of ordinary skill in the art from, the detailed description herein. Also, it should be further appreciated that modifications and variations to the specifically illustrated, referenced, and discussed features, elements, and steps hereof may be practiced in various embodiments and uses of the presently disclosed subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the presently disclosed subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the presently disclosed subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the presently disclosed subject matter, including the best mode thereof, directed to one of ordinary skill in the art, is set forth in the specification, which makes reference to the appended figures, in which:

FIGS. 9A through 9C illustrate, respectively, bottom, top, and side perspective views of an exemplary embodiment of certain other control access features in accordance with presently disclosed subject matter;

Figure 1:
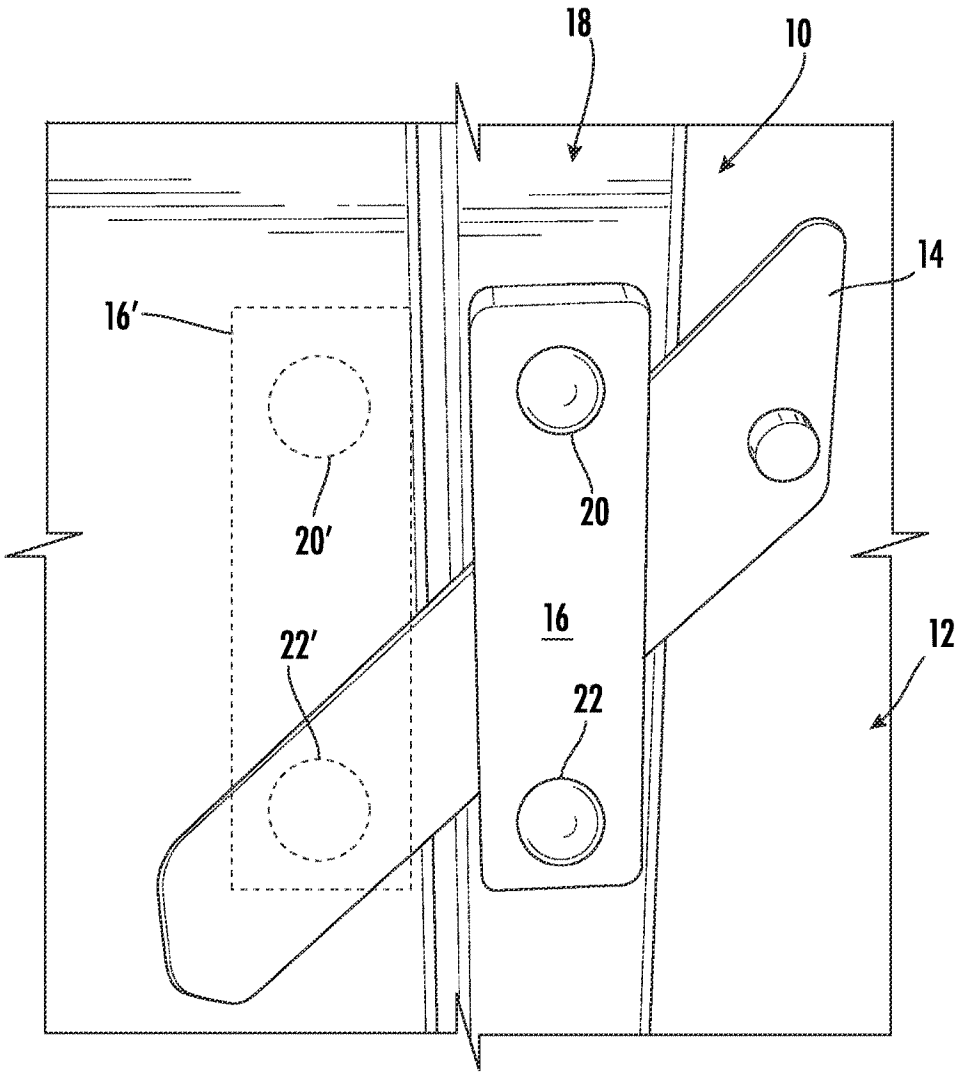
FIG. 1 illustrates a generally front perspective view of an exemplary embodiment of an assembled door barricade incorporating presently disclosed subject matter, and shown in use for actively barricading an associated door.

Repeat use of reference characters throughout the present specification and appended drawings is intended to represent same or analogous features, elements, or steps of the presently disclosed subject matter.

DETAILED DESCRIPTION OF THE PREFERRED EMBODIMENTS

As discussed in the Summary of the Subject Matter section, the presently disclosed subject matter is generally concerned with apparatus and methodologies relating to improved door barricade systems and more particularly to door barricade systems which may be activated from inside an enclosure (or room) while still maintaining controlled serviceability or access to the enclosure from outside of the enclosure.

Selected combinations of aspects of the presently disclosed technology correspond to a plurality of different embodiments of the presently disclosed subject matter. It should be noted that each of the exemplary embodiments presented and discussed herein should not insinuate limitations of the presently disclosed subject matter. Features or steps illustrated or described as part of one embodiment may be used in combination with aspects of one or more other embodiments to yield yet further embodiments. Additionally, certain features may be interchanged with similar devices or features not expressly mentioned which perform the same or similar function or functions.

Reference will now be made in detail to the presently preferred exemplary embodiments of the subject apparatus and associated and/or related methodology.

Figure 2B:
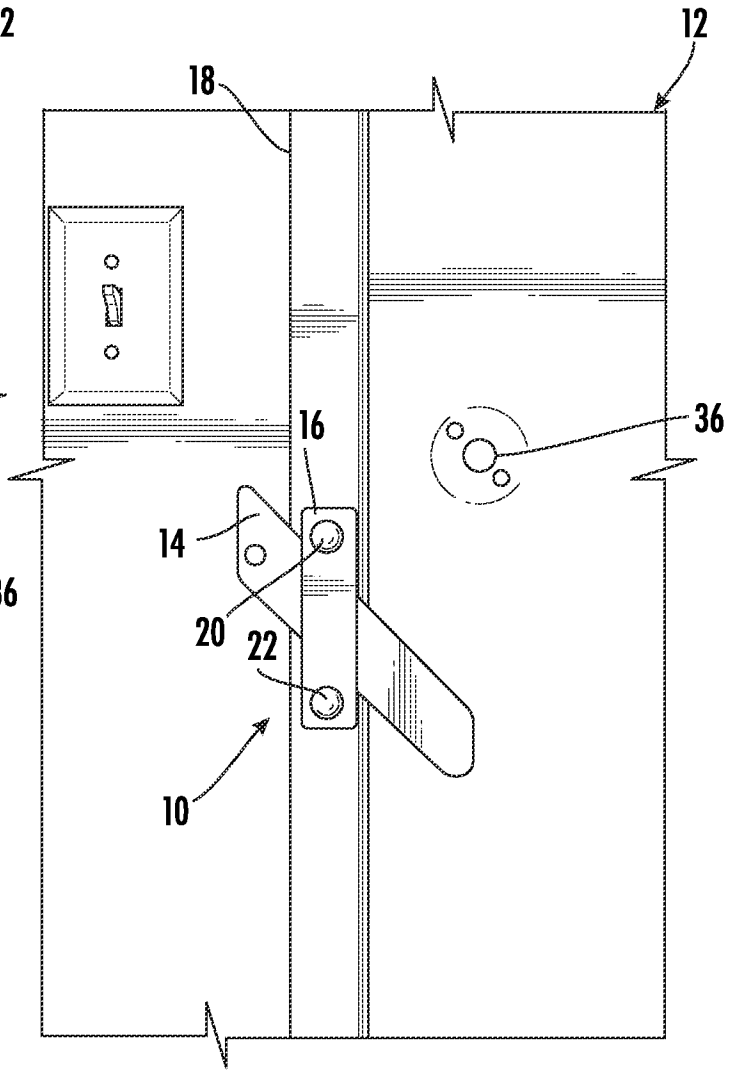
FIGS. 2A and 2B illustrate perspective views of sequenced placement of a door blocking element or component in accordance with an exemplary embodiment of presently disclosed subject matter, in conjunction with use with an exemplary associated door.
Figure 2A:
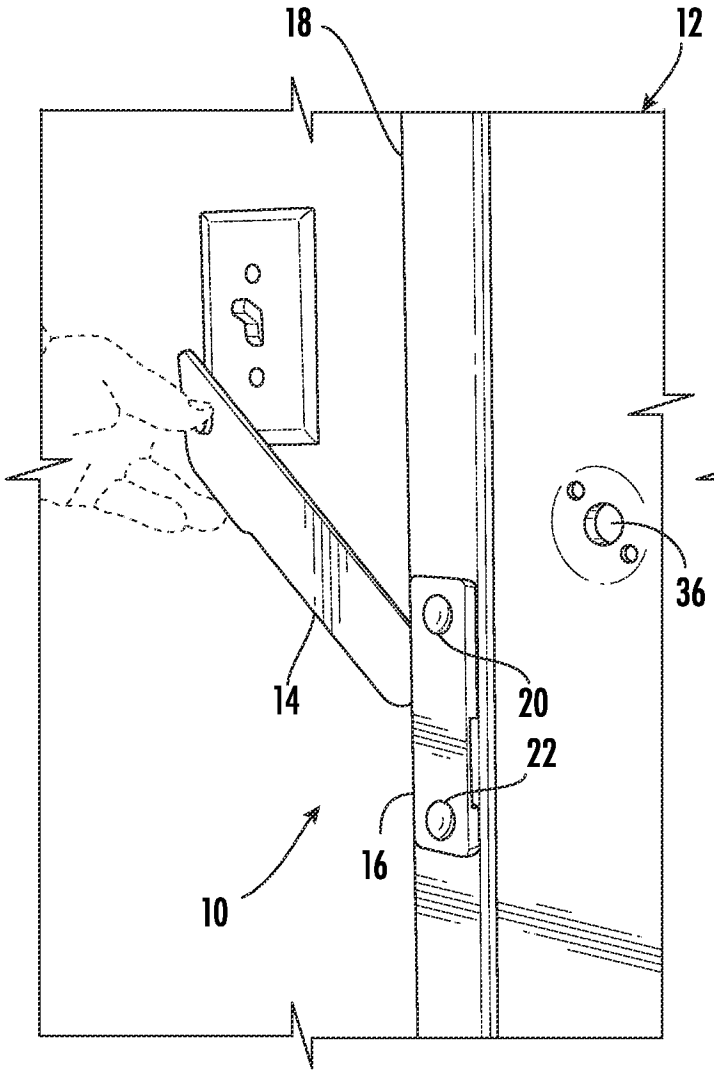

FIG. 1 illustrates a generally front perspective view of an exemplary embodiment of an assembled door barricade generally 10 incorporating presently disclosed subject matter, and shown in use for actively barricading an associated door generally 12. FIGS. 2A and 2B illustrate perspective views of sequenced placement of a door blocking element or component generally 14 in accordance with an exemplary embodiment of presently disclosed subject matter, in conjunction with use with an exemplary associated door 12. In each of these Figures, the exemplary door is arranged to swing into its associated room. As seen, door blocking component generally 14 interacts with a receiving plate generally 16, which is mounted to the associated doorframe generally 18. As will be understood by those of ordinary skill in the art from the complete disclosure herewith, if associated door 12 is instead arranged to swing out from its associate room, then plate 16 may be mounted instead on the door itself, as represented in FIG. 1 by plate 16'.

As further discussed herein, plate 16 may be secured to doorframe 18 in some embodiments by at least a pair of bolts which pass through the doorframe. FIGS. 1, 2A, and 2B illustrate representative bolt heads 20 and 22. Similarly, bolt heads 20' and 22' are represented in conjunction with the alternate embodiment represented by plate 16'.

FIGS. 1, 2A, and 2B also represent that door block 14 generally passes between plate 16 (or 16') and the doorframe 18 (or door 12), through an enlarged passage area shown in conjunction with other present Figures. In particular, FIG. 2A illustrates blocking member 14 just as it is introduced into some passage underneath plate 16, or just as it is about to be completed removed from such passage as the door 12 is unblocked. FIGS. 1 and 2B represent the member 14 fully seated, so that door 12 is fully blocked.

In such regard, those of ordinary skill in the art will appreciate that it is intended that such components of the presently disclosed system subject matter are intended as heavy-duty components, in order to best perform the disclosed door blocking function. While various materials may be practiced, use of various heavy-gauge metals are particularly useful in many embodiments.

Figure 3B:
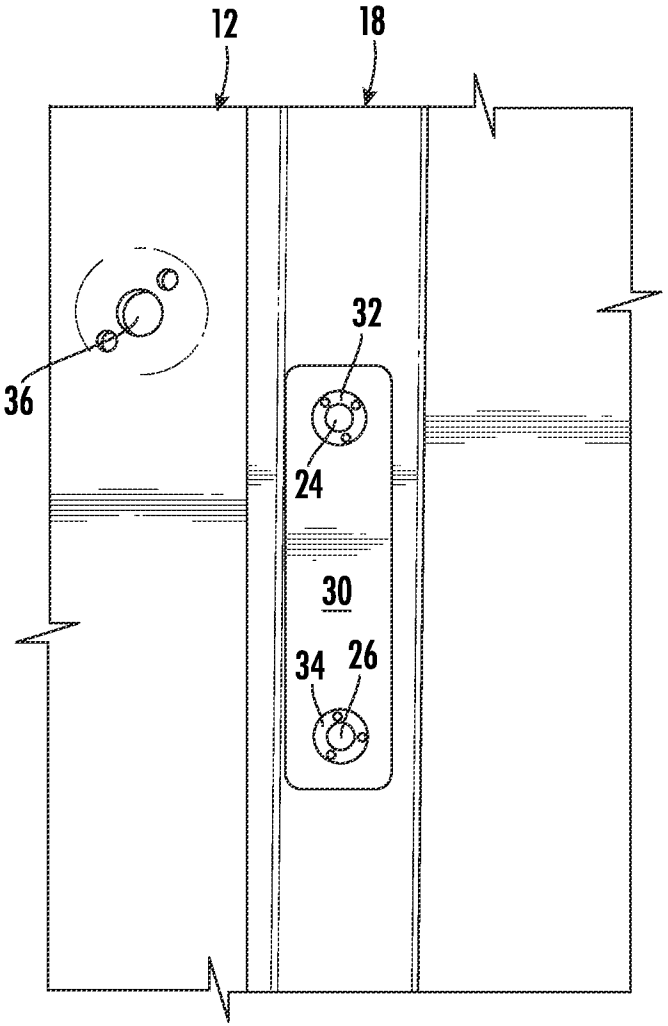
FIGS. 3A and 3B illustrate respective opposite end perspective views of exemplary bolt member components of presently disclosed subject matter, installed for use with an exemplary associated door.
Figure 3A:
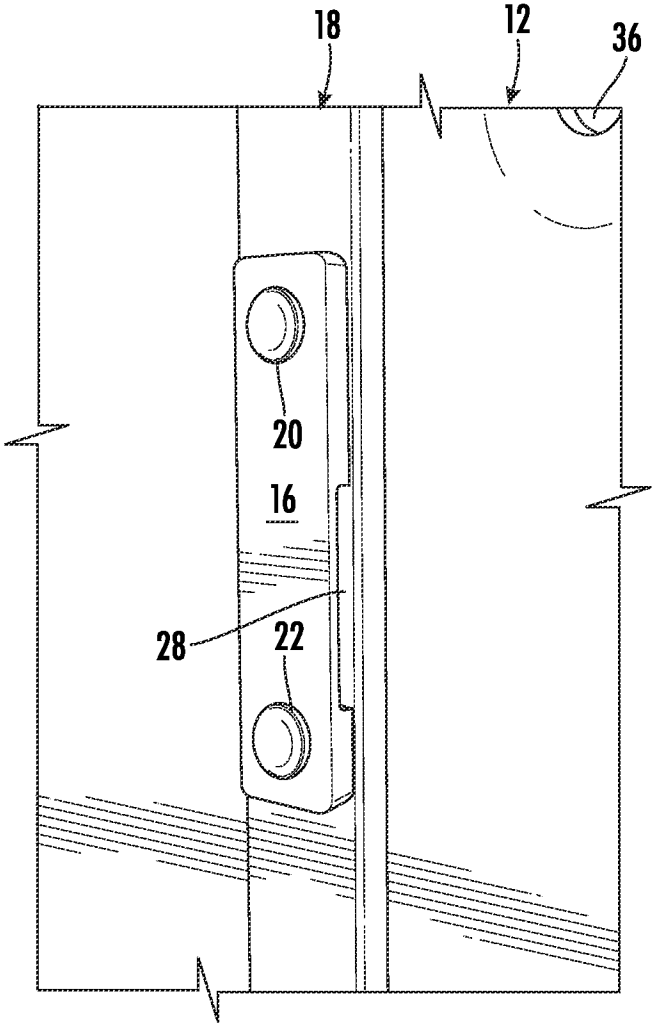

FIGS. 3A and 3B illustrate respective opposite end perspective views of exemplary bolt member components generally 24 and 26 of presently disclosed subject matter, installed for use with an exemplary associated door 12. In addition, FIG. 3A presents a slightly perspective view of plate 16 which reveals a narrow width passage generally 28 formed between plate 16 and doorframe 18, for passage of blocking member 14, as represented in other Figures herewith.

FIG. 3B illustrates that exposed ends 24 and 26 of the bolt members passing through the doorframe 18 are entrained through a further plate generally 30, and then secured by specialized respective nuts 32 and 34. Such nuts have various features, further discussed herein, which provide for controlled access to the associated room by removal or disassembly of the door blocking system. Such controlled access is provided because the specialized features of nuts 32 and 34 require a corresponding specialized, or customized tool for engaging them so that they may be removed from plate 30 and bolt ends 24 and 26. Likewise, the same customized instrument (shown in other Figures herewith) is required in order to facilitate initial installation of presently disclosed door blocking or barricade system generally 10.

FIGS. 2A through 3B also represent that in practice the presently disclosed system generally 10 may be used with doors for which prior door know systems have been removed. See, for example, remaining openings generally 36 in each of such Figures.

Figure 4B:
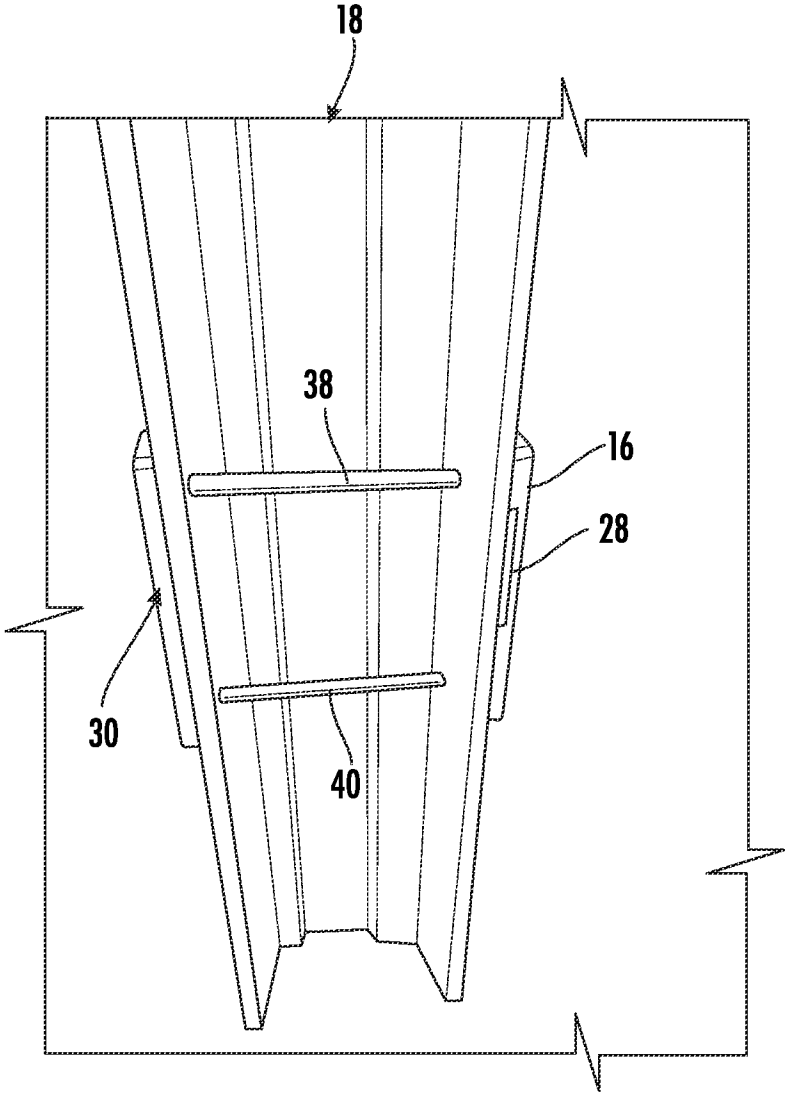
FIGS. 4A through 4C illustrate respective side views of the exemplary bolt member components of subject FIGS. 3A and 3B, but with an exemplary associated door removed to illustrate placement of such exemplary bolt member components relative to doorframe features of the removed exemplary associated door.
Figure 4A:
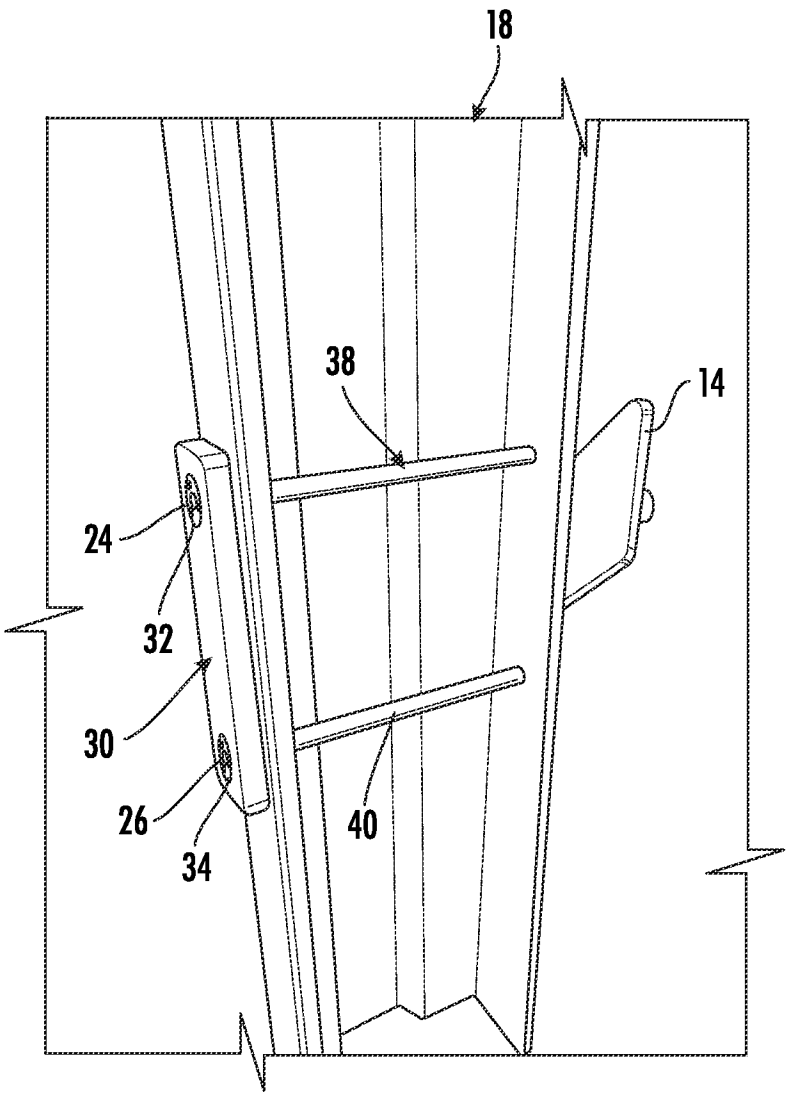
Figure 4C:
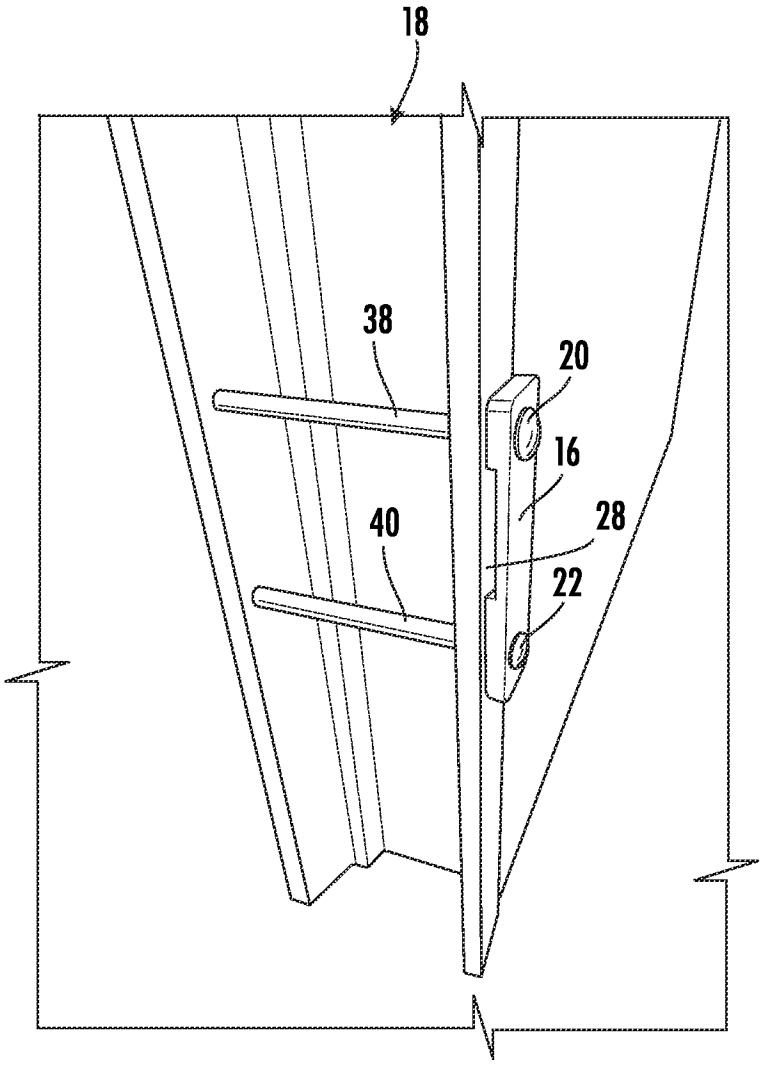

FIGS. 4A through 4C illustrate respective side views of the exemplary bolt member components of subject FIGS. 3A and 3B, but with an exemplary associated door removed to illustrate placement of such exemplary bolt member components generally 38 and 40 relative to doorframe features generally 18 of the removed exemplary associated door. As represented, such bolt members may also in many embodiments be preferably heavy-gauge metal materials, as are other presently disclosed system components. Respective ends 24 and 26 of bolts 38 and 40 may also in some embodiments be threaded for receipt of respective nuts 32 and 34. It should be understood by those of ordinary skill in the art that variations may be practiced for some embodiments, in accordance with the broader disclosure herewith. For example, in place of threaded ends and associated nuts, other mechanisms may be provided, such as the formation of braded ends, or other reversible structures.

Figure 5:
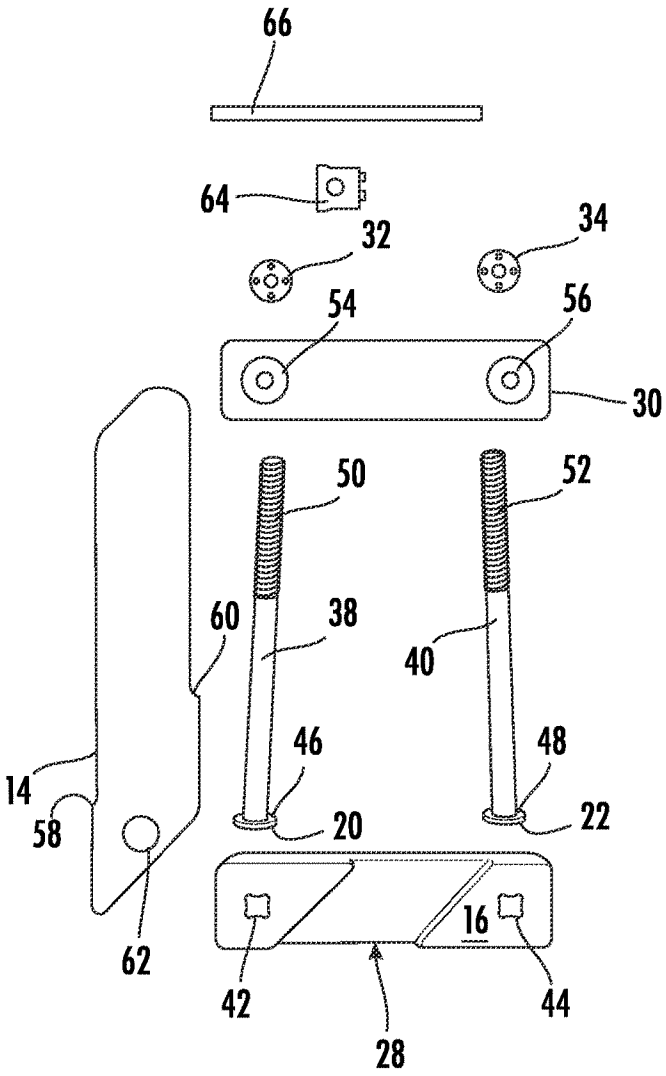
FIG. 5 illustrates an exploded view of exemplary bolt member components of presently disclosed subject matter, and further illustrating associated presently disclosed features for use therewith in accordance with presently disclosed embodiments, as more fully explained herein.

FIG. 5 illustrates a generally exploded view of exemplary respective bolt member components 38 and 40 of presently disclosed subject matter, and further illustrating associated presently disclosed features for use therewith in accordance with presently disclosed embodiments, as more fully explained herein. As shown, the "underside" (turned towards doorframe or door) of plate 16 may have a recessed region for forming passage generally 28. Further, such passage is preferably at an angle to the perpendicular side edges of plate 16, so that door block 14 is assisted by gravity when fully seated into passage 28, as illustrated in various of the subject Figures.

FIG. 5 also illustrates that plate 16 may be formed with generally rectangular openings 42 and 44 for passage and seating of matching portions 46 and 48 of bolts 38 and 40. Once fully seated, interaction of such features help secure the bolts 38 and 40 from rotation, as will be understood by those of ordinary skill in the art. The opposite threaded ends 50 and 52 of bolts 38 and 40, respectively, pass through openings 54 and 56 of plate 30. Such openings 54 and 56 may be preferably countersunk in some embodiments, to help shield externally mounted nuts 32 and 34 from attack by potential intruders.

As further seen in FIG. 5, door block member generally 14 may include protruding shoulders, such as 58 and 60, which interact with plate 16 to limit the amount of projection of the body of member 14 through passage 28. Also, a handle, knob, or similar element 62 may be associated with member 14, to facilitate its handling and manipulation by a user.

FIG. 5 also represents an exemplary specialized or custom drive head generally 64 which may be practiced with some presently disclosed embodiments, as further discussed herein. Also, an exemplary handle 66 may be provided for use with such custom drive head 64, or interchanged for use with other custom drive heads.

For some commercial embodiments, all of the features represented in FIG. 5 might be provided together to a customer, for the installation at a given existing door, as a retrofit feature. Alternatively, some portion of the represented components could be separately provided, for example as replacement components, and/or for changed retrofits where a different custom nut/drive head pair is used.

Figure 6:
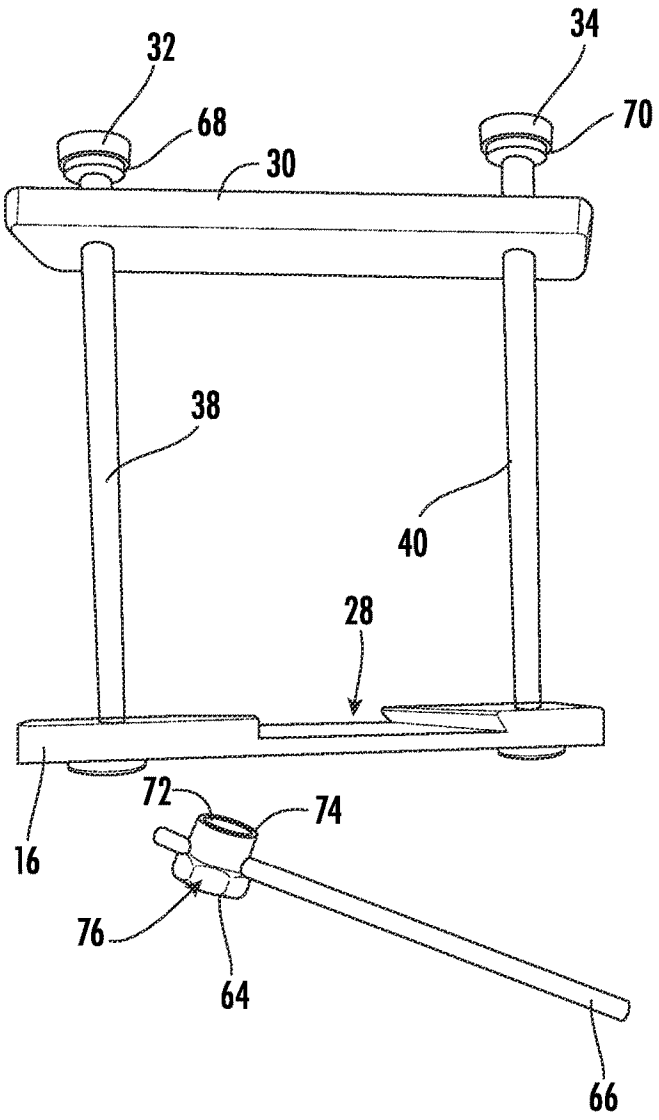
FIG. 6 illustrates a combination view of exemplary bolt member components and further associated presently disclosed features, all of presently disclosed subject matter, as at least partially shown in exploded view in subject FIG. 5.

FIG. 6 illustrates a combination view of respective exemplary bolt member components generally 38 and 40 and further associated presently disclosed features, all of presently disclosed subject matter, as at least partially shown in exploded view in subject FIG. 5. In particular, relatively enlarged views of specialized or custom nuts 32 and 34 represent countersinking features or offsets 68 and 70 thereof, for respective interface with countersinking features of openings 54 and 56. As will be understood, such countersinking helps reduce the overall profile of nuts 32 and 34 relative to plate 30, which helps protect such nuts from attack by an unauthorized intruder.

FIG. 6 further represents exemplary custom drive head 64 mounted on exemplary handle 66. Custom head 64 has various features as otherwise discussed herein, such as projecting pins 72 and 74, for engaging correspondingly formed openings or depressions in the face of custom nuts 32 and 34. When engaged, the custom fit between the custom drive head and the associated matched custom nuts permits the drive head to turn the nuts in a desired direction, for either securing onto bolt threaded ends 50 and 52 or for removal therefrom. In addition to use of handle 66, drive head 64 may be provided with beveled edges 76 for engagement with a ratchet drive or other similar wrenching mechanism, for controlled and selected rotation of the drive head 64.

Figure 7B:
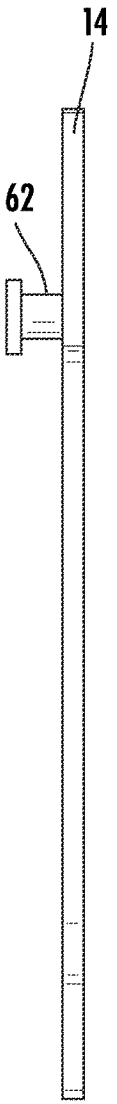
FIGS. 7A and 7B illustrate, respectively, top and side edge isolated perspective views of door blocking element or component subject matter in accordance with an exemplary embodiment of presently disclosed subject matter, as otherwise also represented in subject FIGS. 2A and 2B.
Figure 7A:
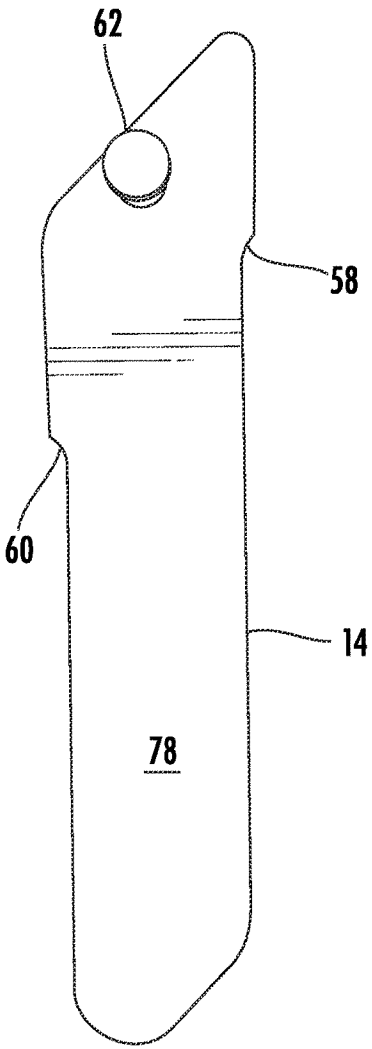

FIGS. 7A and 7B illustrate, respectively, top and side edge isolated perspective views of door blocking element or component generally 14 in accordance with an exemplary embodiment of presently disclosed subject matter, as otherwise also represented in subject FIGS. 2A and 2B, and elsewhere. In particular, FIG. 7A offers additional perspective on respective shoulder features 58 and 60 in that they represent the broader aspect of member 14 relative to the main body portion generally 78 thereof which is inserted into passage 28. At the same time, FIG. 7B offers additional perspective on the relatively significant thickness of member 14, to facilitate its ability to serve the door blocking function. Of course, specific thicknesses may be varied for particular embodiments, with corresponding adjustments made as needed to associated passage 28.

FIGS. 8A through 8D illustrate, respectively, top, bottom, side, and perspective views of an exemplary embodiment of certain control access features in accordance with presently disclosed subject matter. Such features include the custom drive head 64 as well as its removable handle 66. Such handle 66 has a reduced diameter portion generally 80 for being inserted into the head 64, as illustrated. As otherwise discussed herein, head 64 may in some embodiments also be outfitted with exterior beveled edge features such as angled edge 76, which may be engaged by a drive wrench or similar technology, so that head 64 may be rotated as desired without having to use handle 66.

Figure 8D:
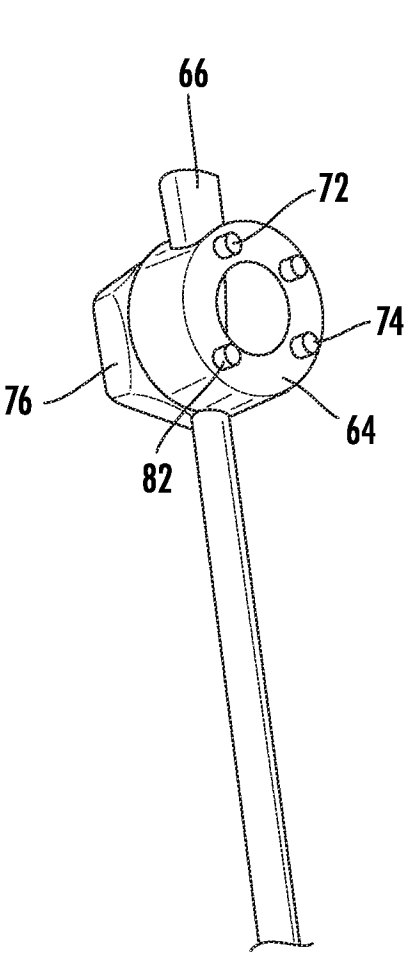
FIGS. 8A through 8D illustrate, respectively, top, bottom, side, and perspective views of an exemplary embodiment of certain control access features in accordance with presently disclosed subject matter.
Figure 8C:
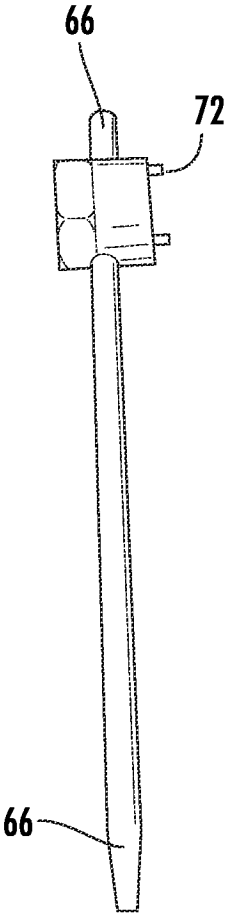
Figure 8B:
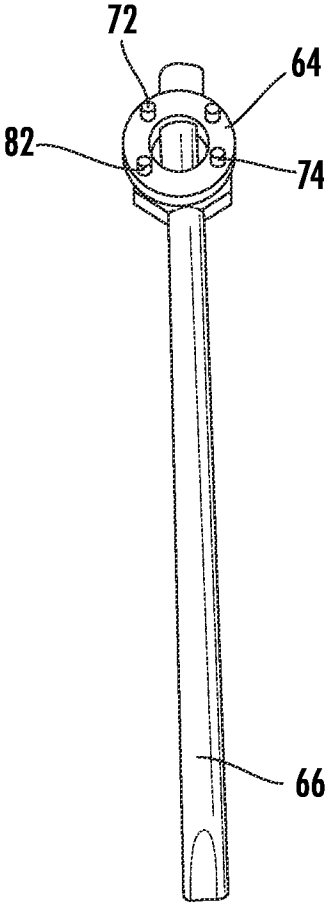
Figure 8A:
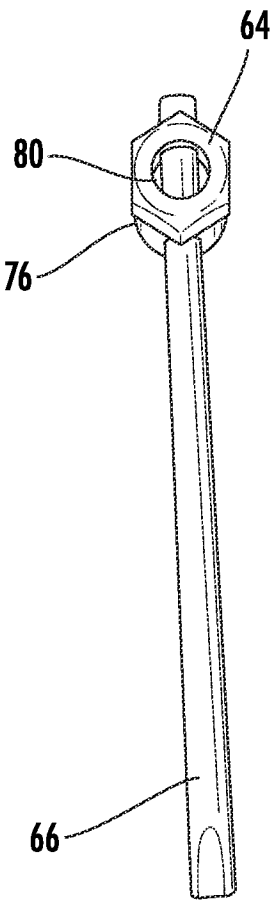

Another aspect of custom drive head 64 as represented particularly by FIGS. 8B and 8D is that custom-located pins or projections 72, 74, and 82 may be integrally formed with, or otherwise securely attached to, head 64. Such engagement pins are intended to have a number (such as two to four or more), which will match in both number and respective positions with corresponding holes or depressions in custom nuts 32 and 34. Those of ordinary skill in the art will understand that the custom placement of corresponding holes and pins in the nuts and on the drive head may be varied from installation to installation. In that way, authorized staff at a particular building may have or have access to a matching custom drive head for particular door barricade systems installed in the particular building or facility. Similarly, if copies of the custom features became compromised in any way, new associated sets of different custom nuts could be fabricated and traded out for existing nuts in existing installations of the subject system, without otherwise requiring all the other components of the system to be changed out. Also, different custom arrangements could be used for one nut versus another nut as used in a given system installation, so that correspondingly two different control access custom drive heads would be required for controlled access by removal of the system from an associated door. Such dual-custom system could provide an additional layer of security in an overall implementation.

FIGS. 9A through 9C illustrate, respectively, bottom, top, and side perspective views of an exemplary embodiment of certain other control access features in accordance with presently disclosed subject matter. In particular, paired sets of custom control access nuts 32 and 34 are provided. They each may in some embodiments include countersinking features 68 and 70, respectively, as otherwise discussed herein. For matching in this example the three-pin drive head otherwise illustrated and discussed herewith, three openings or holes 84, 86, and 88 may be placed on an outside surface generally 90 of nuts 32 and 34. It will be understood that the size, position, and number of such holes are custom fabricated to match with the size, position, and number of the exemplary three-pin arrangement, so that exemplary custom drive head 64 may be operational with each of custom nuts 32 and 34. The exemplary patterns are in essence keyed to one another, so at permit operations on the custom nuts by the associated custom drive head. It should be understood that if the pins of the custom drive head did not in any respect match up with the holes of the custom nuts, then the drive head would not be operational with the custom nuts. In such way, having authorized access to the correctly corresponding custom drive head established controlled access for overcoming the physical door barricade which is otherwise provided.

Figure 10C:
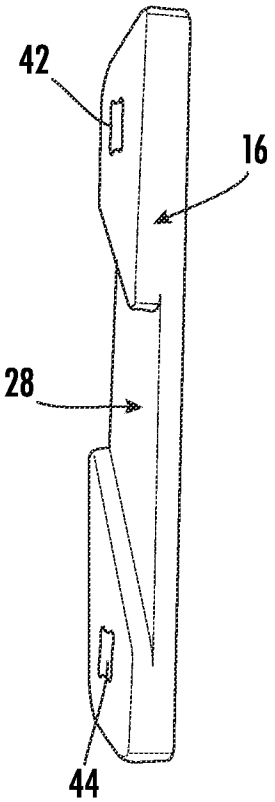
FIGS. 10A through 10C illustrate, respectively, back, front, and generally side edge perspective views of an exemplary embodiment of certain plate features in accordance with presently disclosed subject matter.
Figure 10B:
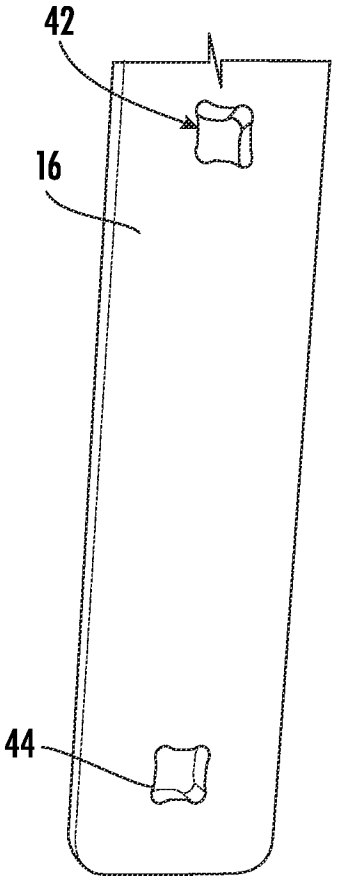
Figure 10A:
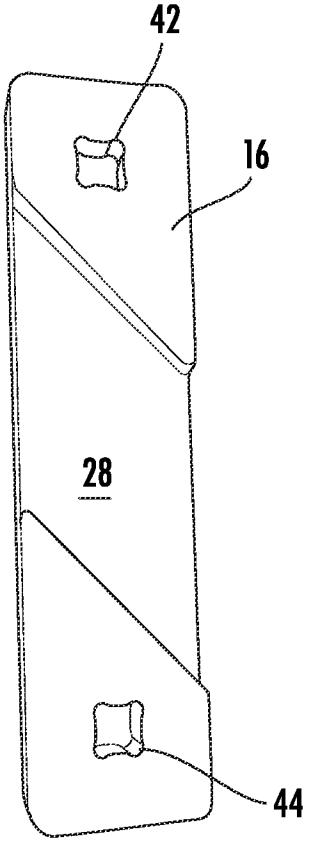
Figures 11A, 11B, 11C, 11D:
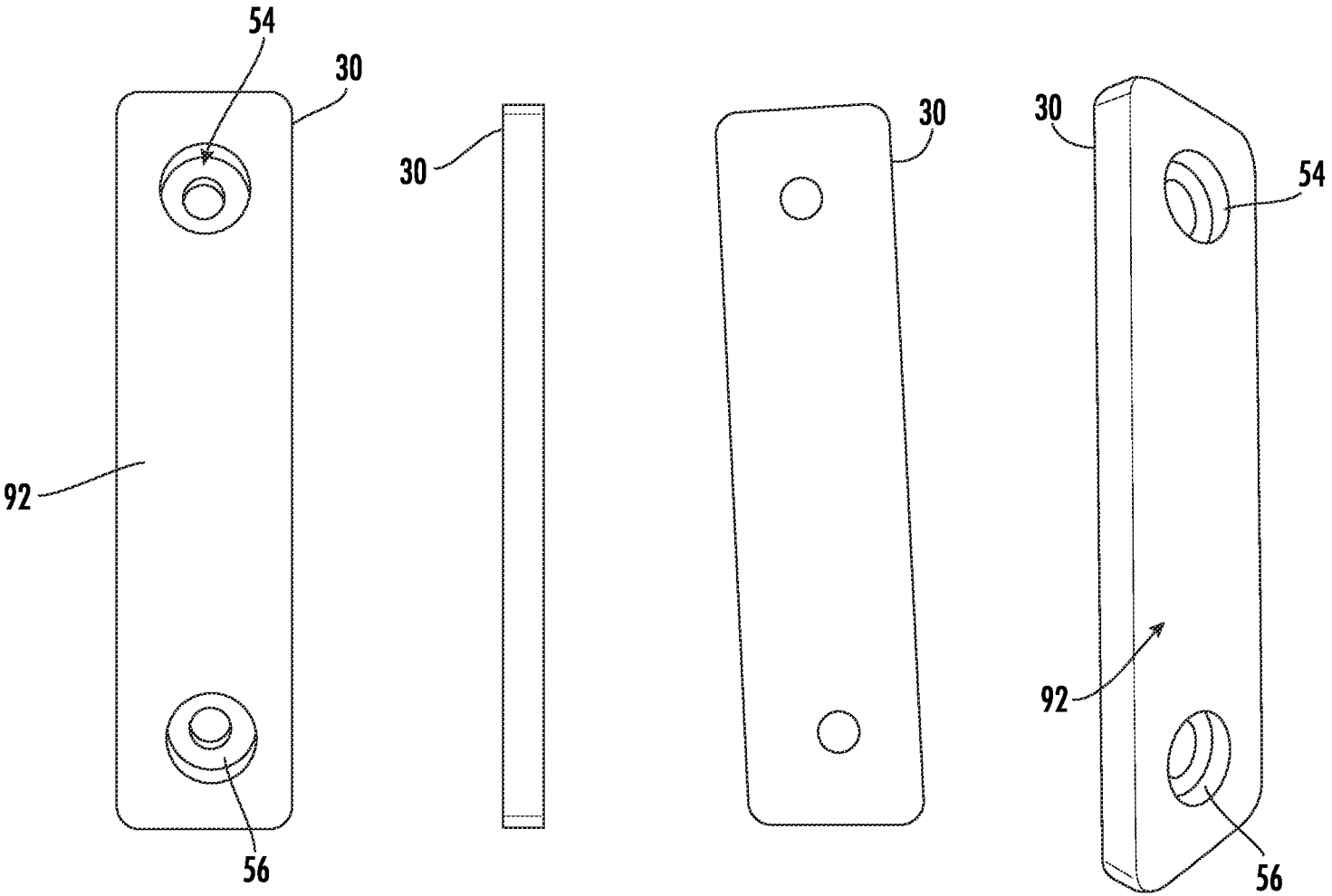
FIGS. 11A through 11D illustrate, respectively, front, side edge, back, and generally front and side perspective views of an exemplary embodiment of certain other plate features in accordance with presently disclosed subject matter.

FIGS. 10A through 10C illustrate, respectively, back, front, and generally side edge perspective views of an exemplary embodiment of certain plate generally 16 features in accordance with presently disclosed subject matter. As otherwise discussed herein, generally rectangular respective openings 42 and 44 allow for passage of respective bolts therethrough, while also permitting engagement with correspondingly shaped features of the bolts to keep such bolts from rotating when seated against the rectangular portions. It is to be understood that other respectively matching geometric or other shapes could be used in some other embodiments to achieve the same function.

As otherwise discussed herein, passage 28 establishes a passageway for door block member 14, with the angled side edges of passage 28 creating a gravity-aided arrangement.

FIGS. 11A through 11D illustrate, respectively, front, side edge, back, and generally front and side perspective views of an exemplary embodiment of certain other plate generally 30 features in accordance with presently disclosed subject matter. All such Figures illustrate and represent that plate 30 is a substantially feature, preferably formed from heavy-gauge metal or equivalent heavy-duty materials. Openings 54 and 56 are illustrated in both FIGS. 11A and 11D with countersinking features or offsets, to permit custom nuts to be arranged generally more flat with exterior turned surface 92 of plate 30.

Figure 12B:
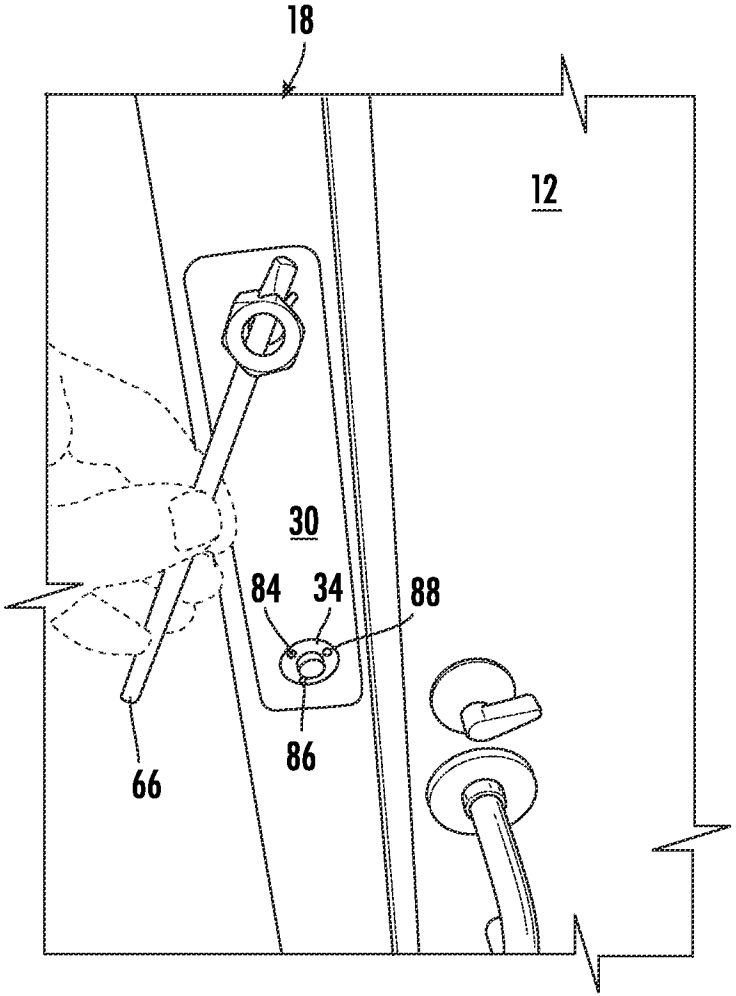
FIGS. 12A and 12B illustrate generally perspective views of sequenced controlled access features in accordance with an exemplary embodiment of presently disclosed subject matter, in conjunction with use with an exemplary associated door.
Figure 12A:
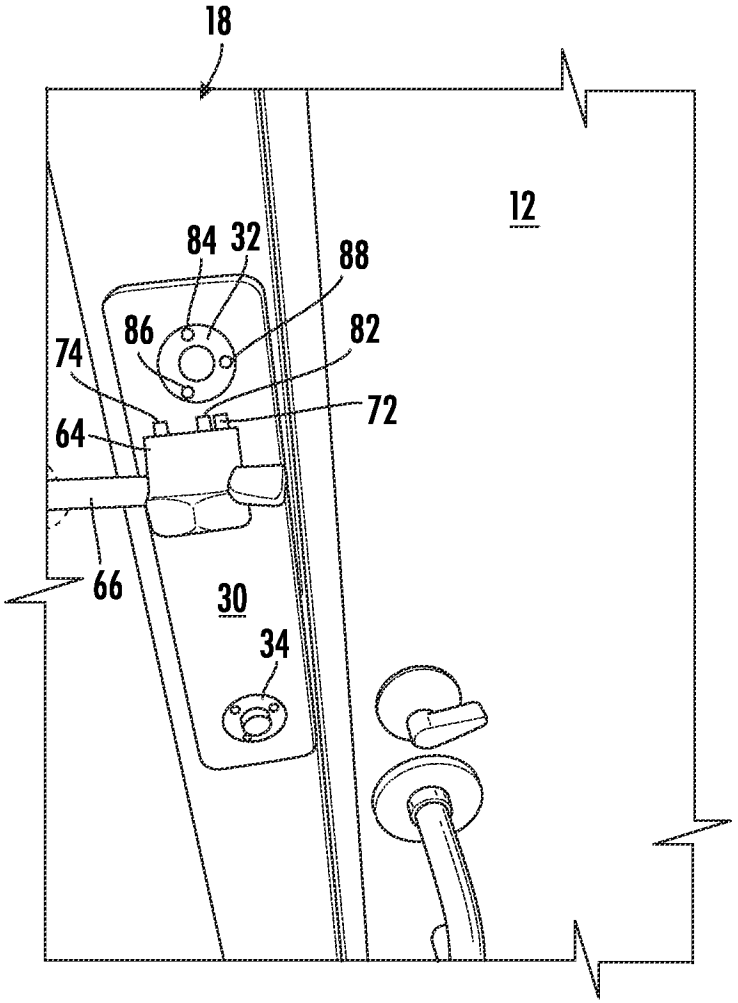

FIGS. 12A and 12B illustrate generally perspective views of sequenced controlled access features in accordance with an exemplary embodiment of presently disclosed subject matter, in conjunction with use with an exemplary associated door, and per corresponding and/or associated presently disclosed methodology. In particular, FIG. 12A illustrates a doorframe-mounted (18) exterior plate 30 of presently disclosed subject matter, installed relative to an associated door 12. It should be understood that throughout the subject disclosure, there has been no discussion of potential wall materials (such as cinderblock walls seen in FIGS. 2A and 2B since such features form no particular aspect of presently disclosed subject matter. Similarly, the location of some walls would be understood by those of ordinary skill in the art but are not necessarily illustrated in Figures herewith, such as in the instance of subject FIGS. 12A and 12B.

FIG. 12A illustrates that a matching custom drive head 64 is received on a handle 66 and has three protruding custom pins 72, 74, and 82, which may be received in corresponding custom holes or openings 84, 86, and 88 of custom nuts 32 and 34. In FIG. 12B, the drive head 64 is positioned over the custom nut 32 and applied so that a user as illustrated may engage the custom nuts and turn them so as to release the door barricade system from its door mounting. As will be understood, once both custom nuts 32 and 34 are removed, the bolts may be pushed through to remove interior plate 16 from its mounted position, so that the door barricade is removed.

The presently disclosed subject matter, both apparatus and methodology, has a number of positive and useful traits, some of which are already otherwise referenced herein. For example, the overall system can be provided as a retrofit product, which may be readily and quickly installed in many door/doorframe arrangements. Once installed, the door block feature can be actuated in seconds if need be, which makes it very favorable for addressing even emergent circumstances, for example, an active shooter emergency. The associated door may be locked/barricaded from the inside of the associated room, without having to open the door to any potential threat, and without having to check a door handle.

Furthermore, the user/operator, for example, such as a teacher, has clear, firm visual confirmation that the classroom door is locked. This may be particularly highlighted through the use of bright colors, such as red or orange, for the door blocking component.

With no springs or internal mechanisms, there is no possibility of any malfunction due to a part failure.

To best meet needs in a particular room, the system can be readily installed at various different nominal heights above the floor, for example between 34 and 48 inches, or otherwise, depending on the circumstances.

The system as designed per some embodiments thereof has added features to help withstand potential intruder attacks from blunt force or prying tools. Also, despite all such advantages, the door barricade/lock system can still be removed from outside of the barricaded door if personnel have the appropriate controlled access instruments, which amount to a custom "key" for the subject custom system.

Those of ordinary skill in the art will understand from the complete disclosure herewith the various aspects of corresponding and/or associated methodology, both with providing and installing the presently disclosed subject matter, and with its use in practice.

Throughout, repeat use of the same reference numbers as in other figures is intended to represent similar or same features or steps, with pertinent discussion applicable thereto. Also, the exemplary illustrations are intended as representative only, and variations in such arrangements, and uses of different materials or sizes of particular elements, while maintaining an effective controlled access door barricade system, are intended to come with the spirit and scope of the present disclosure. The presently disclosed subject matter is also intended to encompass variations such as reversal of parts (for example, holes formed in a custom drive head matching custom pins on custom nuts), or mere changes in numbers (such as four pins or two pins or others instead of a three pin arrangement).

While the presently disclosed subject matter has been described in detail with respect to specific embodiments thereof, it will be appreciated that those skilled in the art, upon attaining an understanding of the foregoing, may readily produce alterations to, variations of, and/or equivalents to such embodiments. Accordingly, the scope of the present disclosure is by way of example rather than by way of limitation, and the subject disclosure does not preclude inclusion of such modifications, variations, and/or additions to the presently disclosed subject matter as would be readily apparent to one of ordinary skill in the art.

What is claimed is:

1. A controlled access door barricade system for retrofit use with an existing doorframe and associated door for securing an associated room, comprising:

a pair of respective bolts with respective threaded ends on one end thereof and bolt heads on respective opposite ends thereof, for mounting through only one of an existing doorframe or its associated door;

an interior plate received on a side of the associated door interior to the associated room, with said bolts passed therethrough with said bolt heads exposed to the associated room on the interior side of the associated door;

an exterior plate received on a side of the associated door exterior to the associated room, with said bolts passed therethrough with said bolt threaded ends exposed to the exterior side of the associated door;

a pair of nuts receivable on said bolt threaded ends for securing said bolts and said interior and exterior plates relative to the doorframe and associated door whenever said nuts are tightened on said bolt threaded ends with said pair of nuts exposed to the exterior side of the associated door;

a channel at least partially formed by said interior plate and open on both ends of said channel for receipt of a manually removable separate door block member completely through said channel; and a separate door block member removably receivable in said channel by a user situated on the interior side of the associated door;

wherein said nuts include custom drive engagement features, for controlled access to the interior of the room through use of a corresponding custom drive head with said bolts even when said door block member is received in said channel, with said custom drive engagement features and custom drive head including matching pins and holes having matching size, position and number of mated hole and pin pairs, and wherein said door block member is visible on the interior side of the associated door when received in said channel, so that the associated room is visibly securable from inside the room while maintaining controlled access to the room from outside of the room.

2. A controlled access door barricade system as in claim 1, wherein said separate door block member is sized to extend at least partially across both the existing doorframe and its associated door whenever received in said channel, for creating an interference block to opening of the associated door.

3. A controlled access door barricade system as in claim 2, wherein said pair of respective bolts are mounted through an existing doorframe, and the associated door is hinged to pivot in towards the interior of the associated room, such that receipt of said separate door block member in said channel interferes with opening of the associated door in an inward direction.

4. A controlled access door barricade system as in claim 2, wherein said pair of respective bolts are mounted through the associated door, and the associated door is hinged to pivot out towards the exterior of the associated room, such that receipt of said separate door block member in said channel interferes with opening of the associated door in an outward direction.

5. A controlled access door barricade system as in claim 1, wherein said channel is formed at an angle to perpendicular side edges of said separate door block member, so that said separate door block member is assisted by gravity when fully seated into said channel.

6. A controlled access door barricade system as in claim 1, wherein:

said interior plate forms rectangular openings for passage and seating of matching portions of said bolt heads to secure said bolts from rotation; and said exterior plate forms countersink openings for receipt of said nuts, to shield said nuts from attack by potential unauthorized intruders.

7. A controlled access door barricade system as in claim 1, wherein said bolts, said plates, and said nuts comprise metal components.

8. A retrofit barricade system for an existing doorframe for securing an associated door and room, comprising:

a pair of respective bolts with respective threaded ends on one end thereof and bolt heads on respective opposite ends thereof, for mounting through only an existing doorframe;

respective interior and exterior plates received on opposite sides of the doorframe, with said bolts passed therethrough with said bolt heads exposed to the interior side of the associated room;

a pair of nuts receivable on said bolt threaded ends for securing said bolts and said interior and exterior plates relative to the doorframe whenever said nuts are tightened on said bolt threaded ends with said pair of nuts exposed to the exterior side of the associated door;

a channel at least partially formed by said interior plate and open on both ends of said channel for receipt of a manually removable separate door block member completely through said channel; and a separate door block member removably receivable in said channel by a user situated on the interior side of the associated door;

wherein said nuts include custom drive engagement features, for controlled access to the interior of the room through use of a corresponding custom drive head with said bolts even when said separate door block member is received in said channel, with said custom drive engagement features and custom drive head including matching pins and holes having matching size, position and number of mated hole and pin pairs, and wherein said door block member is visible on the interior side of the associated door when received in said channel, so that the associated room is visibly securable from inside the room while maintaining controlled access to the room from outside of the room;

said bolts, said plates, and said nuts comprise metal components; and said separate door block member is sized to extend at least partially across both the existing doorframe and its associated door whenever received in said channel, for creating an interference block to opening of the associated door.

9. A retrofit barricade system as in claim 8, wherein:

said interior plate forms rectangular openings for passage and seating of matching portions of said bolt heads to secure said bolts from rotation; and said exterior plate forms countersink openings for receipt of said nuts, to shield said nuts from attack by potential unauthorized intruders.

10. A retrofit barricade system as in claim 8, wherein:

said custom drive engagement custom located hole features comprise three openings formed on an outside surface of said nuts; and said custom drive head comprises a corresponding pattern three-pin drive head, custom fabricated to match with size, position, and number of said three openings.

11. Methodology for retrofit use of a controlled access door barricade system with an existing doorframe and associated door for securing an associated room, comprising:

providing a pair of respective bolts with respective threaded ends on one end thereof and bolt heads on respective opposite ends thereof;

mounting the pair of respective bolts through only one of an existing doorframe or its associated door;

providing an interior plate received on a side of the associated door interior to the associated room, with said bolts passed therethrough with said bolt heads exposed to the associated room on the interior side of the associated door, with a channel at least partially formed by said interior plate and open on both ends of said channel for receipt of a manually removable separate door block member completely through said channel;

providing an exterior plate received on a side of the associated door exterior to the associated room, with said bolts passed therethrough with said bolt threaded ends exposed to the exterior side of the associated door;

threading a pair of nuts on said bolt threaded ends for securing said bolts and said interior and exterior plates relative to the doorframe and associated door by tightening said nuts on said bolt threaded ends with said pair of nuts exposed to the exterior side of the associated door, wherein said nuts include custom drive engagement features, for controlled access to the interior of the room through use of a corresponding custom drive head with said bolts even when said separate door block member is received in said channel with said custom drive engagement features and custom drive head including matching pins and holes having matching size, position and number of mated hole and pin pairs; and selectively removably receiving a separate door block member in said channel by a user situated on the interior side of the associated door, and wherein said door block member is visible on the interior side of the associated door when received in said channel, so that the associated room is selectively visibly securable from inside the room while maintaining controlled access to the room from outside of the room.

12. Methodology as in claim 11, wherein:

said separate door block member is sized when received in said channel to extend at least partially across both the existing doorframe and its associated door for creating an interference block to opening of the associated door; and said bolts, said plates, and said nuts comprise metal components.

13. Methodology as in claim 12, further including mounting said pair of respective bolts through an existing doorframe, and wherein the associated door is hinged to pivot in towards the interior of the associated room, such that receipt of said separate door block member in said channel interferes with opening of the associated door in an inward direction.

14. Methodology as in claim 12, further including mounting said pair of respective bolts through the associated door, and wherein the associated door is hinged to pivot out towards the exterior of the associated room, such that receipt of said separate door block member in said channel interferes with opening of the associated door in an outward direction.

15. Methodology as in 11, wherein said channel is formed at an angle to perpendicular side edges of said separate door block member, so that said separate door block member is assisted by gravity when fully seated into channel.

16. Methodology as in claim 11, wherein:

said interior plate forms rectangular openings for passage and seating of matching portions of said bolt heads to secure said bolts from rotation; and said exterior plate forms countersink openings for receipt of said nuts, to shield said nuts from attack by potential unauthorized intruders.

* * * * *